US005413351A

United States Patent [19]

Franklin

[11] Patent Number: 5,413,351

[45] Date of Patent: May 9, 1995

[54] METHOD OF PLAYING A DICE GAME

[76] Inventor: Thomas L. Franklin, 810 Ford St., Gulfport, Miss. 39507

[21] Appl. No.: 270,160

[22] Filed: Jul. 1, 1994

[51] Int. Cl.[6] ..... A63F 3/00

[52] U.S. Cl. ..... 273/274; 273/309

[58] Field of Search ..... 273/146, 309, 274

[56] References Cited

U.S. PATENT DOCUMENTS

| | | | |
|---|---|---|---|
| 4,334,685 | 6/1982 | Robbins et al. | 273/274 |
| 4,635,938 | 1/1987 | Gray | 273/146 |
| 5,133,559 | 7/1992 | Page | 273/146 |

OTHER PUBLICATIONS

Excerpt from "Scarnes's New Complete Guide To Gambling," copyright 1974.

SIC-BO game advertisement, circa unknown.

*Primary Examiner*—Benjamin H. Layno

*Attorney, Agent, or Firm*—Quirk & Tratos

[57] ABSTRACT

A dice game involving wagering on the outcome of a toss of three dies. A player places a first bet means. If the dealer throws a preselected winning combination, such as a 4-5-6, triple, or pair and a 6, the dealer wins. If the dealer throws a preselected losing combination, such as a 1-2-3 or a pair and a one, the dealer loses. If the dealer throws a third combination, such as a pair and a 2-3-4 or 5, then the player throws in an attempt to beat the dealer. If the player throws a preselected combination, such as a 4-5-6, or a pair and single die having a value higher than that of the dealer, the player wins. If the player throws a preselected loser, such as a 1-2-3, or a pair and single die having a value less than that of the dealer, the player loses. If the player or dealer does not throw one of above stated winning or losing combinations, then the dealer or player must throw again. Each player may place a second bet that the outcome of the game will result in predetermined winning die combination yielding a predetermined winning payout. A player may also place bonus bet means, wherein if that particular throw results in a preselected combination, such as triple sixes, the player is entitled to a throw. If the player throws another preselected combination, such as a triple six, the player is entitled to a large winning payout.

19 Claims, 1 Drawing Sheet

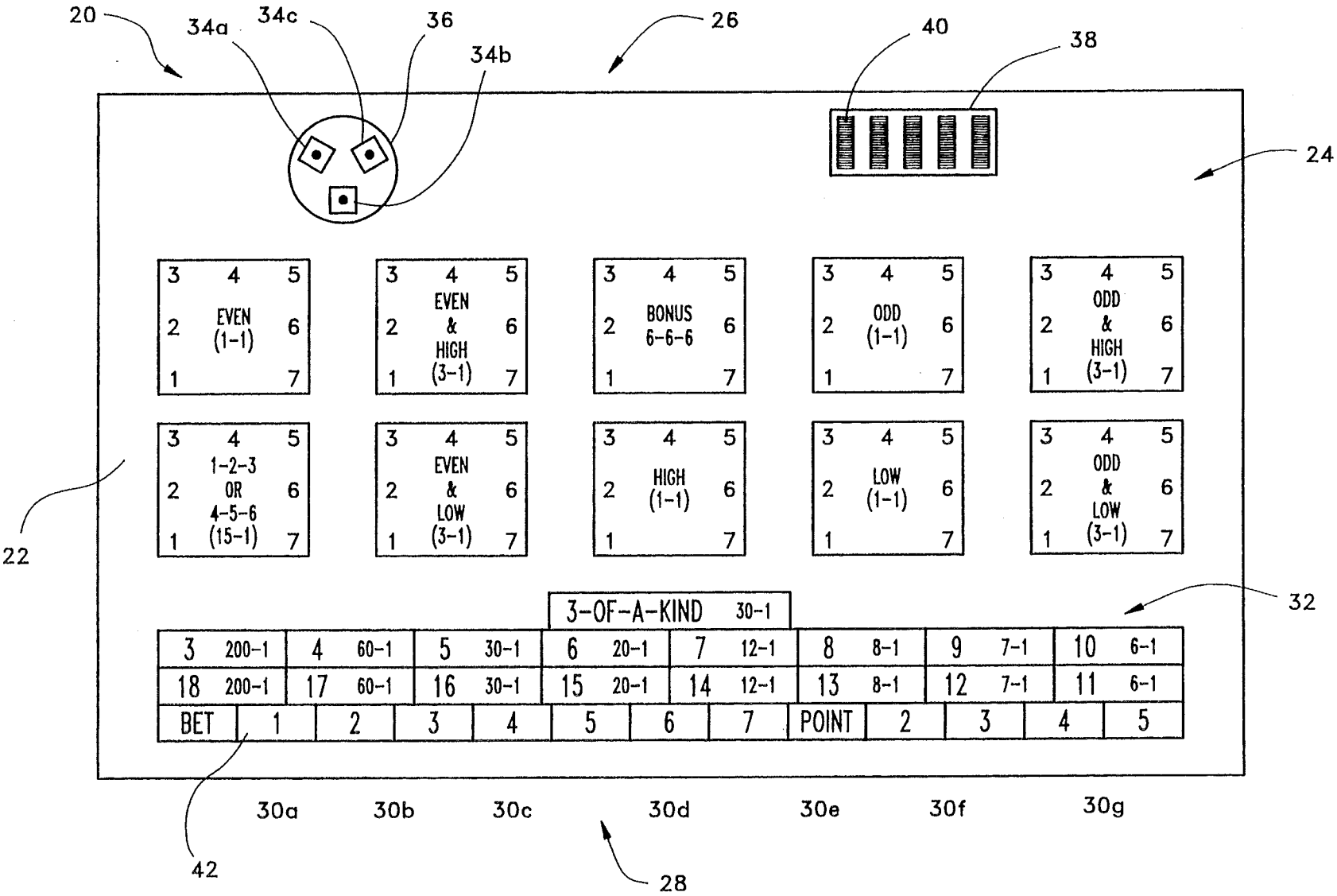
20
22
24
26
28
30a
30b
30c
30d
30e
30f
30g
32
34a
34b
34c
36
38
40
42
EVEN (1-1)
EVEN & HIGH (3-1)
EVEN & LOW (3-1)
1-2-3 OR 4-5-6 (15-1)
BONUS 6-6-6
HIGH (1-1)
ODD (1-1)
ODD & HIGH (3-1)
LOW (1-1)
ODD & LOW (3-1)
3-OF-A-KIND 30-1
POINT
BET
3 200-1
18 200-1
4 60-1
17 60-1
5 30-1
16 30-1
6 20-1
15 20-1
7 12-1
14 12-1
8 8-1
13 8-1
9 7-1
12 7-1
10 6-1
11 6-1

METHOD OF PLAYING A DICE GAME

FIELD OF THE INVENTION

The present invention relates to a dice game. In particular, the present invention relates to a game where players place a variety of bets dependent on the outcome of the roll of three dies.

BACKGROUND OF THE INVENTION

Players of games of skill and chance are constantly seeking games offering greater excitement and higher payoffs. In an attempt to make games more exciting, many have invented games utilizing different chance mediums, such as cards, rotating reels in slot machines, rotating wheels in roulette, or dice or the like. Further, others have attempted to make existing games more exciting by allowing raising the stakes or providing a larger jackpot. For example, slot machines are often linked to one another, whereby the player of one machine who obtains a winning result receives a large jackpot based on the total play of the linked machines.

While new and more exciting games are continuously being developed, none offer, in a single game, the most exciting and pleasurable aspects present in the more popular existing games. For example, roulette offers players the advantage of numerous combinations of wagers, the player betting on "black," "white," "odd," "even," or individual numbers. On the other hand, roulette offers very little player interaction or participation, and for this reason is not as popular as it might be.

Numerous card games exist. Many players, however, do not wish to invest the time necessary to learn all of these games, including their intricate set of house-specific variations. Further, many players find these card games slow and inactive. Many games are objected to by players because play is against other players, and not against the house.

A game that is fast and offers much player excitement is craps. This game involves the throwing of two dies. Unfortunately, the game is complex and difficult to learn, deterring many from playing it.

SUMMARY OF THE INVENTION

A dice game is provided which is easy to learn, fast moving, and offers player participation and a variety of wagering.

The game of the present invention involves wagering on the outcome of the throw or shake of three dies. A player places first bet means on the outcome of a dealer throw of the dies. Each player who places a first bet has the option to place at least one second bet, and/or a bonus bet.

If the dealer throws a preselected winning combination, such as a 4-5-6, triple, or pair and a 6, the dealer wins and collects the first bets from each player. If the dealer throws a preselected losing combination, such as a 1-2-3 or a pair and a one, the dealer loses and each player is paid a payout based on the first bet. If the dealer throws a third combination, such as a pair and a 2-3-4 or 5, then the player throws in an attempt to beat the dealer. If the throw does not result in a preselected winning or losing combination, or a combination in which the player is entitled to throw, no action occurs with respect to the first bet.

If the player is entitled to throw to beat the dealer, the player throws, and if a preselected combination occurs, such as a 4-5-6, triple, or a pair and single die having a value higher than the single die of the pair and single thrown by the dealer, the player wins a payout on the first bet. If the player throws a preselected loser, such as a 1-2-3, or a pair and single die having a value less than that of the dealer, the player loses and the dealer collects the first bet. If the player or dealer does not throw one of above stated winning or losing combinations, then the dealer or player must throw again until a winning or losing combination occurs.

As to every throw of the dies, whether by a player or the dealer, every player (including the player throwing) may place a second bet that the outcome of the game will result in predetermined winning die combination yielding a predetermined winning payout. For example, a player may bet that the sum value of the dies is an "odd" value or an "even" value, or is greater than a predetermined value, or less than a predetermined value. Thus, regardless of the outcome of the throw of the dies with respect to the first bet, all second bets must be paid or lost with respect to every throw.

Every player who places a first bet is entitled to place a bonus or third bet, either separately or in addition to any second bet. If a throw by the dealer or player results in a predetermined bonus throw combination, such as 6-6-6, each player having placed a bonus bet is entitled to a throw. If this bonus throw results in a predetermined bonus combination, such as a triple, the player receives a payout in excess of 1000 times the bonus bet. In a preferred embodiment, the bonus bet is $1 and the player receives 2500 times the bonus bet if a triple is thrown, and receives 25000 times the bonus bet if a 6-6-6 is thrown.

Further objects, features, and advantages of the present invention will become apparent from the detailed description of the drawings which follows, when considered with the attached figures.

DESCRIPTION OF THE DRAWINGS

FIG. 1 illustrates a preferred table and layout for use in practicing the present invention.

DETAILED DESCRIPTION OF THE PREFERRED EMBODIMENT

The game of the present invention will be described with reference to FIG. 1, which illustrates a gaming table 20 for use in playing the game of the present invention. In general, the table 20 comprises a flat surface 22 having a betting layout 24 thereon. The table 20 includes a first side 26 for location of a dealer and a second side 28 for location of one or more players.

The table 20 is preferably rectangular, although it may be round or arcuate in shape. Preferably, the game is played by a maximum of seven players 30*a–g*, the table 20 including the same number of player positions. It is possible for a greater number of players to play the game, or for fewer players to play the game.

The layout 24 includes a number of betting zones 32 in which a player places chips, money or other gaming tokens. The exact number, size and location of the zones 32 may vary, depending on the exact variation of the game being played.

In general, in the game of the present invention, players place one or more bets into the appropriate zones on the table. The dealer then shakes the three dies and examines them. Depending on the result of the shake, player's wagers are either collected by the dealer or players are paid a payout. In the event certain die combinations arise, a player may be entitled to a shake the dies himself.

Three standard six-sided dies 34*a,b,c*, are used to play the game of the present invention. These dies 34*a,b,c* preferably have dots or other number symbols indicating the values of 1 thru 6, respectively, on each face of the die. It is possible for the die to have any variety of indicia on each side or face, but preferably the die include six different indicia ranked from highest to lowest in value.

These dies 34*a,b,c*, are initially placed in an enclosed cup 36. Preferably, the dealer places the cup 36 directly on the dealer's side of the table, and on his right side. The cup 36 is of a standard variety, preferably including a removable cover, the cover being placed over the cup by the dealer before the dealer shakes, and removed by the dealer to expose the dies after the shake.

The term "shake" or "throw" as used herein broadly means a random distribution of the dies 34*a,b,c* so as cause one face of each of the dies to face upwardly. Preferably a player or the dealer grasps the cup 36, imparting motion upon it to move the dies 34*a,b,c* within the cup 36, and then places the cup 36 on the table 20.

The outcome of the shake is represented by the particular face of each die 34*a,b,c* facing upward. Only one side of each die 34*a,b,c* can face upward for a valid roll. In the event one or more of the die 34*a,b,c* are not squarely seated on the bottom of the cup 36, the dealer preferably calls "no roll" and the dealer suspends the outcome of the game pending a re-shake by himself or the appropriate player.

While it is preferred that the value of the dies be determined by the procedure above, any number of procedures may be employed for "throwing" the dies. For example, while not preferred for the reasons set forth below, the dies 34*a,b,c* may be thrown from the hand or a cup onto a surface. Further, the dies 34*a,b,c* may be tumbled in a cage or other device. Further, the dies 34*a,b,c* may be electronically created, such that the "roll" of the dies comprises the pressing of one or more buttons on a machine which randomly creates a three die roll.

It is preferred to locate the dies 34*a,b,c* within the enclosed cup 36 for security purposes. It is possible for a player or the dealer to shake the dies and throw them from an open cup onto the table. This arrangement, however, presents the opportunity for die switching and other tampering with the game. Location of the dies 34*a,b,c* in the cup 36 prevents tampering with the die and reduces the possibility of the dies 34*a,b,c* landing on an uneven surface and the shake resulting in a "no roll."

The dealer is provided with a rack 38 of chips or other gaming tokens 40 for paying out winners of the game. Further, each player position includes a specified area for location of money or gaming tokens to be bet.

In order to participate in the game, a player 30*a–g* places first bet means on the outcome of a shake of the dies 34*a,b,c*. This bet means is placed in a player position zone 42 labelled on the layout 24. Each of the player positions 30*a–g* has a corresponding player zone 42 which is number to match the player position. Thus, player 1 places his first bet means in player position zone one.

The first bet is a wager on the outcome of a throw of the dies as against the dealer or house. In particular, the wager is that the house will either shake a predetermined winning or losing die combination, or that if certain predetermined combination arises, that the player's shake will beat it.

In a preferred embodiment of the game, a player automatically loses his first bet means if the dealer shakes a predetermined dealer winning combination. In the preferred embodiment, this combination includes a 4-5-6, a "triple" (i.e., all three dies having the same indicia), or a pair (i.e. two dies having face up indicia of the same value) and a "single" (a third die having a face up indicia different than the pair, which die is called the "point") with a point of 6 (or the otherwise highest value indicium).

On the other hand, the player is paid an amount equal to the first bet means (i.e., 1 to 1 odds) if the dealer shakes a predetermined dealer losing combination. In the preferred embodiment, this combination includes 1-2-3 or a pair in combination with a point of 1 (or the otherwise lowest value die).

If the dealer shakes a pair and single where the point value is 2, 3, 4, or 5, each player having placed the first bet is given an opportunity to beat that point. If the player shakes a predetermined winner, preferably a 4-5-6, a triple, or a pair-and-single where the single or "point" has a greater value than the dealer's point, then the player wins the game. If the player shakes a predetermined losing combination, such as a 1-2-3 or a pair-and-point having a value less that the dealer's, the player loses the first bet means. If the player shakes a pair-and-point having the same value as the dealer's point, the game is declared a tie and no money is exchanged.

If the player does not shake a predetermined winning or losing combination, such as a pair-and-point or a 1-2-3, 4-5-6, or a triple, then player shakes again, with play continuing until such time as the player wins or loses the first bet means.

If multiple players have placed a first bet, a dealer winning shake results in all players losing their first bet means. If dealer shakes a losing combination, each player so betting is given the proper payout. If the dealer shakes a pair and a point of 2-3-4 or 5, then each player is given the opportunity to shake to beat the dealer. Thus, the process described above regarding player shakes was for a single player. When more than one player is entitled to an opportunity to shake and beat the dealer, each player shakes in succession until each of the players entitled to shake to beat the dealer have taken their turn and won or lost.

If the dealer does not initially shake a predetermined dealer winning or losing combination, such as a 1-2-3, 4-5-6 or a pair-and-point, the player may either remove his first bet, increase the first bet (but not above a table limit) or leave the first bet. The dealer then shakes again, with the outcome depending on the steps described above.

As a further aspect of the present game, each player is given the opportunity also to place additional wagers on a variety of proposition bets on the outcome of every shake. For example, a player may place one or more bets that the particular shake will result in one of a predetermined set of winning outcomes having a preselected payout. The preselected winning outcomes preferably include the following, each of which is described in more detail below: "high," "low," "odd," "even," "triples," "4-5-6 or 1-2-3," and certain sums of the three dies.

One of the preselected winning combinations may be that the sum of the dies 34*a,b,c* after a shake will be a low total. As meant herein "low" generally means that the total of the dies does not exceed a predetermined sum, such as 10. If the shake results in a die total of this amount, each player wagering a second bet means in the "low" zone 32 is declared a winner, returned their wager and given a payout.

Preferably, the winning payout on this bet is 1 to 1. If the sum of the dies is not "low," the dealer collects the amounts wagered by the players in this zone 32. In a preferred version of this wager, players lose their bet if the shake results in triple 2's or triple 3's.

Players preferably are given the opportunity to wager that the sum of the dies will exceed a predetermined sum, or be "high." As used herein, "high" preferably means that the sum of the dies after a shake is 11, 12, 13, 14, 15, 16, or 17. In the event the sum of the dies is one of these amounts, players who have wagered a second bet means in the appropriate "high" zone are returned their wager and given a payout.

Preferably, the payout for this winning bet is 1 to 1. If the sum of the dies is not "high," the dealer collects the amounts wagered by the players in the appropriate "high" zone. In a preferred version of the game, players automatically lose their wager if triple 4's or triple 5's are shaken by the dealer.

A player may bet that each die 34*a,b,c* will have the same face value, i.e. a "three-of-a-kind" or "triple." Preferably, a zone 32 is located on the table for placement of a bet that a triple will be shaken. If a triple or three-of-a-kind is thrown, a multiple payout, e.g. 30 times the amount wagered is paid. In the event no triple is thrown, the dealer collects all player's bets in this zone 32.

Zones 32 are preferably provided for wagering on the three-die total. Preferably, zones 32 are for placement of wagers on die totals of 4, 5, 6, 7, 8, 9, 10, 11, 12, 13, 14, 15, 16, and 17. The payout odds for these wagers are preferably as follows: values 3 or 18, odds 200 to 1; values 4 or 17, odds 60 to 1; values 5 or 16, odds 30 to 1; values 6 or 15, odds 20 to 1; values 7 or 14, odds 12 to 1; values 8 or 13, odds 8 to 1; values 9 or 12, odds 7 to 1; and values 10 or 11, odds 6 to 1. In the event a player places a second bet in the proper zone 32, the dealer pays winning bets in accordance with the above-stated odds. In event a die total other than the total the player has wagered on occurs, the dealer collects the wager and the player loses.

A player may bet that the sum of the dies 34*a,b,c* will be an odd number: 5, 7, 9, 11, 13, 15, or 17. In the event a shake results in an odd die total, a player having wagered on "odd" is preferably paid an amount equal to the wager. In the event the die total is an even number, the player loses his wager to the dealer. In a preferred form of the game, if the dealer shakes a triple 1's, 3's or 5's, the player automatically loses his wager.

Alternately, a player may bet that the sum of the dies 34*a,b,c* will be an even value: 4, 6, 8, 12, 14, 16, or 18. In the event a shake results in an even die total, a player having bet "even" is preferably paid an amount equal to the wager. In the event the die total is an odd number, the player loses his wager to the dealer. In a preferred form of the game, if the dealer shakes triple 2's, 4's or 6's, the player loses his second wager.

A player preferably is paid odds of 15 to 1 for a winning bet that the shake will result in the three dies showing either 1-2-3 or 4-5-6. If the player so bets and the dies do not have these values, the dealer collects the player's wager. A variety of other proposition bets may be provided other than those disclosed above. In particular, it is preferred that proposition bets on combinations of "high and odd" (i.e. 11 , 13, 15, and 17), "high and even" ( i.e. 12, 14, 16 and 18), "low and odd" (i.e. 1, 3, 5, 7, and 9) and "low and even" (i.e. 2, 4, 6, 8, and 10) be provided. In each of the preferred embodiment of each of these variations, a player who wins the bet is paid odds of 3 to 1, and if the dealer shakes a triple, the player automatically loses.

If the dies do not have normal dot indicia marked on them, the predetermined winning combinations may be selected from any combination of the indicia which are used on the dies. For example, if symbols such as A, B, C, D, E, and F are used and given corresponding values from highest to lowest, respectively, a winning combination might be D, E, and F or the like.

Thus, as part of the game involving the first bet means, a player may bet on the particular outcome of any dealer or player shake. Thus, a player who places first bet means may also place one or more second bet means on the outcome of the initial dealer shake. In the preferred embodiment, if the dealer's shake resulted in a 4-5-6 or pair and a point of 6, that player would lose his first bet means. The player would win a payout on the second bet means, however, if the second bet means were placed on the appropriate zone (for example, if the dealer shook a 4-5-6 and the player betted on "odds"). The same outcome is true if the dealer lost the shake with a combination of 1-2-3 or a pair and point of one, and the player had placed a winning second bet.

If the dealer does not shake a pair-and-point, nor a winning combination (i.e. a 5,7,8), then, as described above, the player's first bet remains untouched. However, any second bet means is reviewed in order to determine if it was a winning or losing bet.

If the dealer shakes a pair and a point of 2-3-4 or 5, then the second bet means are paid or collected (i.e., a pair of 3's and a four would pay second bet means placed on "evens"). Then, every player may bet on the outcome of each shake of every player who shakes against the dealer as to the first bet. Thus, a player who is shaking against the dealer can lose both their first and second bet means in a single toss, or win both bet means simultaneously with a single shake.

A most important player participation aspect of the game involves the ability of a player to place an additional bet for the chance to shake for a bonus sum. In particular, each player who places a first bet means has the option of placing a "bonus" or third bet in addition to, or apart from any second bet. If the player places the bonus or third bet and any shake results in a predetermined bonus shake die combination, preferably three 6's, the player is immediately entitled to a bonus shake. If the dies do not have number indicia on them, the bonus shake may be awarded when the shake results in the dies all having the maximum value indicia. Alternately, the bonus shake may be awarded upon the shaking of any predetermined combination after a bonus bet has been placed.

If the player's bonus shake results in a predetermined player bonus winning combination, preferably triple 6's (or the highest value indicia marked on the dies), the player is preferably paid an amount exceeding at least 1000 times, and preferably at least 10,000 times the third bet. In the preferred embodiment, placement of a $1 third bet means pays $25,000 upon a winning bonus shake. If the bonus shake results in any other triple (i.e. any combination of dies where all of the dies face up side has the same indicia showing) the player is preferably paid at in excess of 500 times, and more preferably in excess of 1,000 times the third bet means. In the preferred embodiment, placement of a $1 third bet results in a payout of $2500 for this bonus shake. If the bonus shake does not results in any other die combination, the player loses his bonus bet. The player loses his second bet if a wager was not made on "triples" and the triple 6's are shaken.

If more than one player places the bonus wager and the shake results in 6-6-6, all of the players so wagering preferably elect a single party to make the bonus shake. If the players cannot mutually agree on a bonus shaker, the dealer shakes for them.

The amount paid out as a result of the bonus shake is a preferred payout, and that an infinite number payouts can be awarded. Further, the criteria for a winning bonus shake could be altered to any other (or even multiple) die combination. It is preferred, however, that the payout for such a set of shakes be large in relation to the "bonus" bet, in order to add excitement to the game.

As further aspects of the game, the house may pre-set a minimum (first) bet to participate, and/or preset a maximum amount which may be placed on any particular bet. The dealer then calls "no more bets" and ensures that all bets are properly located and meet any pre-set maximums or minimums. The dealer or player then shakes the dies as described above.

In accordance with the present game, the house may adopt any number of house-specific rules which apply to the game. For example, the house may reserve the right to raise or lower the wager maximum or minimum on within a specific time frame. Further, the house may require that all winning bets which will result in a payout over a certain amount be verified before the dealer pays it.

The house may also vary the terms of the game. For example, a "low" bet might only include dies totals of 3 thru 8. Further, the house might not includes one or more of the particular wagers. The house might also add other wagers. For example, it is contemplated that wagers for "odd" and "low" or "odd" and "high" in combination with one another might be devised.

It will be understood that the above described arrangements and methods are merely illustrative of applications of the principles of this invention and many other embodiments and modifications may be made without departing from the spirit and scope of the invention as defined in the claims.

I claim:

1. A method of playing a game with three dies by at least one player and a dealer comprising:

(a) a player placing a first bet means and, optionally, a bonus bet means;

(b) a dealer activating a first throw of three dies;

(c) if the result of the first throw is a dealer-losing combination from a predetermined win-lose schedule, the dealer paying each player a payout based on the first bet means;

(d) if the result of the first throw is a dealer-winning combination from the win-lose schedule, the dealer collecting the first bet means; and (e) if the result of the first throw is a bonus combination from the predetermined win-lose schedule, each player who has placed a bonus bet means activating one player throw of the dice, and paying each player whose player throw is a player-bonus combination a payout of at least 1000 times the amount of the bonus bet.

2. The method of claim 1, wherein said bonus combination is dies having the same maximum value indicia.

3. The method of claim 1, wherein said bonus combination is triple sixes.

4. The method of claim 1, wherein said player-bonus combination is dies all having the same value indicia.

5. The method of claim 1, wherein said payout is in excess of 1000 times the bonus bet, unless said dies all have the maximum value indicia, in which case the payout is at least 10,000 times the second bet.

6. A method of playing a game with three dies comprising the steps of:

(a) a player placing first bet means, and optionally a second and/or third bet means;

(b) a dealer throwing the three dies;

(c) examining the dies and with respect to said first bet means, paying every player a payout based on the first bet means if the throw results in a preselected dealer losing combination, and collecting every first bet means if the throw results in a preselected dealer winning combination, and if the dealer throw results in a third preselected combination, the player throwing the dies in an attempt to beat the dealer;

(d) examining the dies to determine if the player won the throw of the dies; and.

(e) examining the dies after every throw, and if the player placed a second bet means and a second bet preselected winning combination occurs, said player winning a payout, and if a second bet preselected losing combination occurs, said player losing said second bet.

7. The method of claim 6, wherein if a player placed third bet means, checking the dies after every throw to determine if the dies all have the maximum value indicia, and if so, the player throwing the dies, and examining the dies and paying a player a first predetermined payout in excess of 1000 times the second bet if each of the dies have the same value indicia, and if the three dies each have the maximum value indicia, paying the player in excess of 10,000 times the second bet.

8. The method of claim 6, wherein said player wins the throw of the dies against the dealer if said player throws a preselected winning combination, and loses if said player throws a preselected losing combination.

9. The method of claim 6, wherein said preselected dealer losing combination is dies having values of 1, 2, or 3, or two dies having the same value and a single die having a value of 1.

10. The method of claim 6, wherein said preselected dealer winning combination is dies having values of 4, 5, and 6, dies having the same value indicia, or a two dies having the same value and a single die having a value of 6.

11. The method of claim 6, wherein said third preselected combination is a pair and a single die having a value of 2, 3, 4, or 5.

12. A method of playing a game with three dies comprising the steps of:

(a) a player placing a first bet means, and optionally a bonus bet means;

(b) a dealer throwing the three dies;

(c) if the throw results in a preselected dealer losing combination, the player winning;

(d) if the throw results in a preselected dealer winning combination, the player losing;

(e) if the throw results in a third preselected combination, the player throwing the dies and winning if said throw results in a preselected player winning combination, losing if said throw results in said preselected player losing combination and throwing again if said player neither wins nor loses;

(f) if the player placed bonus bet means before any throw and a preselected bonus throw combination is thrown, the player throwing the dies and winning an amount at least 1000 times the bonus bet means if said player throws a bonus bet preselected winning combination and losing if said bonus bet preselected winning combination is not thrown; and (g) if said dealer throw does not result in said preselected dealer losing combination, winning combination, or said third preselected combination, the game being declared a tie and neither the player nor dealer winning or losing.

13. The method of claim 12, wherein said preselected dealer losing combination is dies having values of 1, 2, or 3, or two dies having the same value and a single die having a value of 1.

14. The method of claim 12, wherein said preselected dealer winning combination is dies having values of 4, 5, and 6, dies having the same value indicia, or a two dies having the same value and a single die having a value of 6.

15. The method of claim 12, wherein said third preselected combination is a pair and a single die having a value of 2, 3, 4, or 5.

16. The method of claim 12, wherein said preselected bonus throw combination is each die having the highest value indicia.

17. The method of claim 12, wherein said preselected bonus bet winning combination is each die having the highest value indicia.

18. The method of claim 17, wherein said player is paid an amount in excess of 10,000 times the bonus bet means if said second bet winning combination occurs.

19. The method of claim 12, wherein said preselected bonus bet winning combination is each die having the same value indicia.

* * * * *